US007412737B2

(12) United States Patent
Hernádez

(10) Patent No.: US 7,412,737 B2
(45) Date of Patent: Aug. 19, 2008

(54) INCLINED INFANT SLEEPER

(75) Inventor: Alfred Hernádez, Boerne, TX (US)

(73) Assignee: Encuenta Designs, L.L.C., Boerne, TX (US)

( * ) Notice: Subject to any disclaimer, the term of this patent is extended or adjusted under 35 U.S.C. 154(b) by 0 days.

(21) Appl. No.: 11/523,189

(22) Filed: Sep. 18, 2006

(65) Prior Publication Data

US 2008/0066236 A1 Mar. 20, 2008

(51) Int. Cl.
*A47C 16/00* (2006.01)

(52) U.S. Cl. ..... 5/655; 5/634

(58) Field of Classification Search ..... 5/655, 5/634; 128/845; 482/142; 292/175, 163
See application file for complete search history.

(56) References Cited

U.S. PATENT DOCUMENTS

| | | | | |
|---|---|---|---|---|
| 2,777,138 | A * | 1/1957 | Gallagher | 5/655 |
| 4,471,767 | A | 9/1984 | Guimond | |
| 4,553,786 | A | 11/1985 | Lockett, III et al. | |
| 4,657,005 | A | 4/1987 | Williamson | |
| 4,862,535 | A | 9/1989 | Roberts | |
| 4,911,105 | A | 3/1990 | Hocum | |
| 4,989,286 | A | 2/1991 | Tucker | |
| 5,014,376 | A | 5/1991 | Doran et al. | |
| 5,127,422 | A | 7/1992 | Colon | |
| 5,208,925 | A | 5/1993 | Edlund | |
| 5,400,803 | A | 3/1995 | Vines | |
| 5,439,008 | A | 8/1995 | Bowman | |
| 5,440,770 | A | 8/1995 | Nichols | |
| 5,483,714 | A | 1/1996 | Casassa | |
| 5,577,503 | A * | 11/1996 | Bonutti | 600/415 |
| 5,700,059 | A | 12/1997 | Moscot | |
| 5,746,219 | A | 5/1998 | McConnell | |
| 5,937,459 | A * | 8/1999 | Binaghi et al. | 5/634 |
| 6,381,785 | B1 | 5/2002 | Mancera Browne et al. | |
| 6,708,356 | B1 | 3/2004 | LaValle | |
| 6,898,812 | B2 | 5/2005 | Smart | |
| 2005/0050638 | A1 * | 3/2005 | Rutkowski | 5/655 |
| 2005/0253432 | A1 | 11/2005 | Flanagan | |
| 2006/0197269 | A1 * | 9/2006 | Downey et al. | 269/111 |

OTHER PUBLICATIONS

Supreme Snuggle Nest with Incline; Baby Delight, Inc., Woodbridge, CA (Advertisement, Copyright 2005).

* cited by examiner

*Primary Examiner*—Patricia Engle
*Assistant Examiner*—William Kelleher
(74) *Attorney, Agent, or Firm*—Kammer Browning PLLC

(57) ABSTRACT

An inclined sleeper assembly for an infant to reduce the risk of gastric and breathing complications during nursing and sleep. The assembly provides a non-slip surface whose angle of inclination can be varied from horizontal up to 30° or more. A rigid platform is pivotally attached to a base frame and may move from a position generally parallel with the base frame to a position of maximum inclination or any intermediate position. Supporting the inclined platform are a pair of slide rods pivotally connected to the base frame at one end and slidingly engaging two releasable clamps on an opposite end. The releasable clamp structure comprises a spring preferenced plate between the sliding clamp enclosures surrounding each of the two slide rods. This permits the user to adjust the inclination of the sleep surface with little disturbance to the infant.

15 Claims, 6 Drawing Sheets

INCLINED INFANT SLEEPER

BACKGROUND OF THE INVENTION

1. Field of the Invention

The present invention relates generally to sleeping surfaces designed for infants. The present invention relates more specifically to an adjustable, variable angle inclined sleeping surface for infants, especially infants experiencing health related digestive and respiratory problems.

2. Description of the Related Art

Young infants are prone to experience a variety of health related issues involving their newly formed digestive systems and respiratory systems. Infants that are born prematurely frequently suffer from gastric reflux conditions and the associated respiratory conditions. Premature infants that experience gastric reflux conditions also tend to be light sleepers. The combination of these two conditions makes it difficult for parents, especially breast feeding mothers, to obtain the necessary rest, both for the infant and the parents.

Many parents decide to have the infant sleep near the mother, co-sleeping, as a partial solution to the problem. Co-sleeping allows the infant to fall asleep while nursing and permits the mother to remain stationary during this time. Problems arise in that, because of the reflux condition, it is better to feed the infant while he/she is sitting or lying at an inclined angle. This position allows gravity to assist the infant in keeping the milk down. The varying severity of the reflux condition requires that some infants be much closer to sitting upright than others. Of course, being very young infants, they are generally incapable of keeping themselves from sliding or moving on an inclined sleeping surface.

Existing solutions to the problems presented by young infants with gastric and breathing complications have utilized inclined sleeping surfaces that incorporate some type of sling or harness to hold the infant in place. However, nursing the infant requires at least partial disassembly of the sling/harness leaving the infant unsecured if the apparatus is at an elevated angle. In addition, VELCRO® hook and loop type material, snaps, zippers, etc. have a tendency to wake light sleepers, not to mention the process of placing the infant into or extracting the infant from the harness arrangement. In addition, many of the existing solutions only allow for a few discreet inclined positions. While a horizontal position is the ideal for sleeping, infants with varying degrees of gastric reflux will require varying degrees of inclination to control the symptoms of the condition. The mechanisms associated with many of the existing devices that allow adjustability in the incline also tend to be noisy, cumbersome, complicated, and prone to breakage.

It would be desirable, therefore, to have a device capable of supporting a young infant on an inclined surface so as to reduce the effects experienced with gastric complications and breathing complications. It would be desirable to have a surface that could easily adjust from a fUlly horizontal position to an inclined position in a manner that did not require the removal of the young infant from the inclined surface. In this manner, it would be possible for a mother nursing her young infant to allow the infant to fall asleep while nursing while situated next to the infant on a bed or the like. Once the young infant was asleep after nursing, the inclined surface could be elevated to a position that helped prevent the occurrence of gastric and breathing difficulties. There are also situations where the mother must (or would prefer to) nurse the infant in an inclined position. In some such cases, it would be desirable for the sleeping surface to be lowered to a horizontal, or nearer to horizontal, position, perhaps after some time has passed since feeding and falling asleep. It would be desirable if such a device did not require the use of harnesses or other specialized clothing that would require manipulating the young infant to the extent that he or she would likely be wakened with such movement. It would be preferable for the surface of the device to be slip resistant in character so as to generally prevent the young infant from sliding down the surface even at a maximum inclination. Most importantly, the mechanism for adjusting the inclination of the surface should operate smoothly so as to not agitate the young infant while sleeping and yet remain very secure in its placement at a number of positions from the horizontal to the maximum inclination.

SUMMARY OF THE INVENTION

The present invention provides an infant sleeping surface having a variable incline angle and a surface that reduces the tendency of the infant to slide. The present invention does away with slings and harnesses to support the infant, and instead provides a surface that helps maintain the infant in place. The surface comprises a celluloid rubber-type mat, much like that used to keep rugs from moving on hard floors. This material is effective in keeping the infant from sliding down the sleeping surface, even in a steep inclination range. The range for the present invention is from a horizontal inclination to approximately 45° from the horizontal. (The maximum angle of inclination is dictated by the angle at which an infant's head would fall toward its shoulder or chest. Reflux is most common in newborn and premature infants who are wholly incapable of holding up their own heads.) In this manner, the infant may be repositioned as needed without the necessity of removing or modifying straps, buttons, or VELCRO® hook and loop type material closures.

The mechanism of the present invention for varying the inclined angle for the sleeper includes a pair of support posts, one positioned on each side of the sleeping surface. These posts pivot on a base frame for the sleeping surface and slide in a gripping mechanism positioned along the top edge of the sleeping surface. The two posts extend through holes in a plate that is pivotally attached to the sleeping surface. This plate is rotated by springs that change the effective diameter of the plate's holes, thereby trapping the posts by friction and not allowing the sleeping surfaces angle to change. To effect a change in the inclination of the sleeping surface, the user simply moves the plate against the springs so that the holes are once again approximately parallel to the posts. This allows the posts to slide through the holes and change the angle of inclination.

An alternative design of the present invention would eliminate the mechanism for varying the inclination and would use other objects, such as pillows, blankets, towels, etc. placed under the support structure to achieve the desired inclination. In this instance the inclined sleeper would simply be a board with the gripping material positioned on top. In another alternative design, the gripping material could be changed to any of a number of fabrics or materials sufficiently resistant to slippage as to maintain the infant in position on the sleeping surface. Such materials could include neoprene, textured plastic, and textured rubber, etc. It is also possible to utilize a variety of new gripping mating materials such as unidirectional velour. In this instance, the infant's clothes might be made from one of the two gripping materials (velour grain down, for example), and the bedding from its complimentary material (velour grain up).

DETAILED DESCRIPTION OF THE PREFERRED EMBODIMENTS

Figure 1:
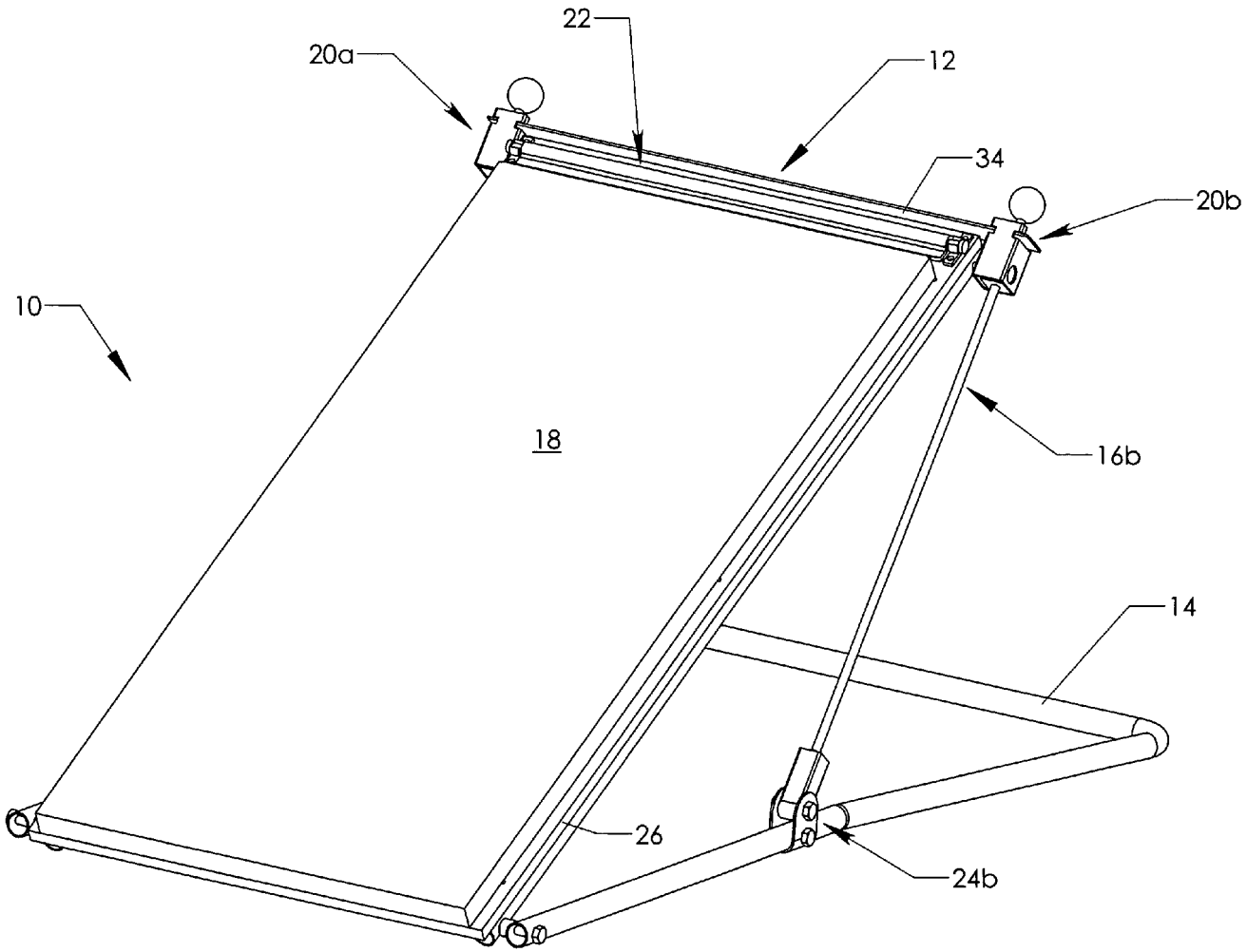
FIG. 1 is an isometric view from the front of the sleeper assembly of the present invention shown in a fully elevated (inclined) position.

Reference is first made to FIG. 1 for a brief description of the basic components of a first preferred embodiment of the complete infant sleeper assembly of the present invention. Sleeper assembly 10 is shown in FIG. 1 in a fully elevated or maximally inclined position. The primary components of assembly 10 include platform sub-assembly 12, base frame 14, and left and right slide sub-assemblies 16*a* and 16*b* (left slide sub-assembly 16*a* not visible in FIG. 1). Platform sub-assembly 12 supports sleep surface 18 and extends from a pivoting connection on base frame 14 to a slide connection on left and right slide sub-assemblies 16*a* (not visible in FIG. 1) and 16*b*. A sleep surface retention sub-assembly 22 is positioned at the upper end of platform sub-assembly 12. The manner in which sleep surface 18 is retained along its upper edge to platform sub-assembly 12 is described in more detail below. Sleep surface 18 is supported on platform sub-assembly 12 by way of backboard 26. The support components for backboard 26 are described in more detail below with respect to FIG. 2 which shows the same structures from a reverse view.

Left and right slide sub-assemblies 16*a* (not visible in FIG. 1) and 16*b* extend from left and right base pivot assemblies 24*a* (not visible in FIG. 1) and 24*b* up to left and right sliding catch sub-assemblies 20*a* and 20*b*. The detailed structures of these assemblies are described below in conjunction with FIGS. 7 and 8.

Sleeper assembly 10, as shown in FIG. 1 may be used in conjunction with any flat support surface, such as a mattress or the like, by placement of base frame 14 on such a support surface and initially inclining sleep surface 18 at the required angle. As indicated above, it may be preferable to incline sleep surface 18 at no angle or only a slight angle during the nursing of the infant positioned on the sleeper assembly. After nursing, and typically after the infant has fallen asleep, sleep surface 18 may be raised to a greater inclination in a manner that helps the infant more easily retain the nursed milk. Movement of the inclined sleep surface 18 from a generally horizontal or no inclination position to an inclined position is accomplished by hand rotating release lever 34 in a manner that simultaneously releases both left and right slide sub-assemblies 16*a* (not visible in FIG. 1) and 16*b*. This process allows left and right sliding catch sub-assemblies 20*a* and 20*b* to slide upward along left and right slide sub-assemblies 16*a* (not visible in FIG. 1) and 16*b* and in the process allows the upper edge of platform sub-assembly 12 to pivot upward away from base frame 14. The operation of sliding catch sub-assemblies 20*a* and 20*b* is sufficiently smooth as to reduce the risk that an infant placed on sleep surface 18 will be woken by either the release and engagement of the mechanism or the sliding adjustment of the inclination of the assembly. As mentioned above, it is not always preferred (or even possible) to nurse with the sleep surface in a horizontal position and then incline the surface for sleeping. In some cases, parents may feed the infant in an inclined position and then lower the surface to a horizontal position after the infant has slept for some time (getting past the threat of reflux).

Figure 2:
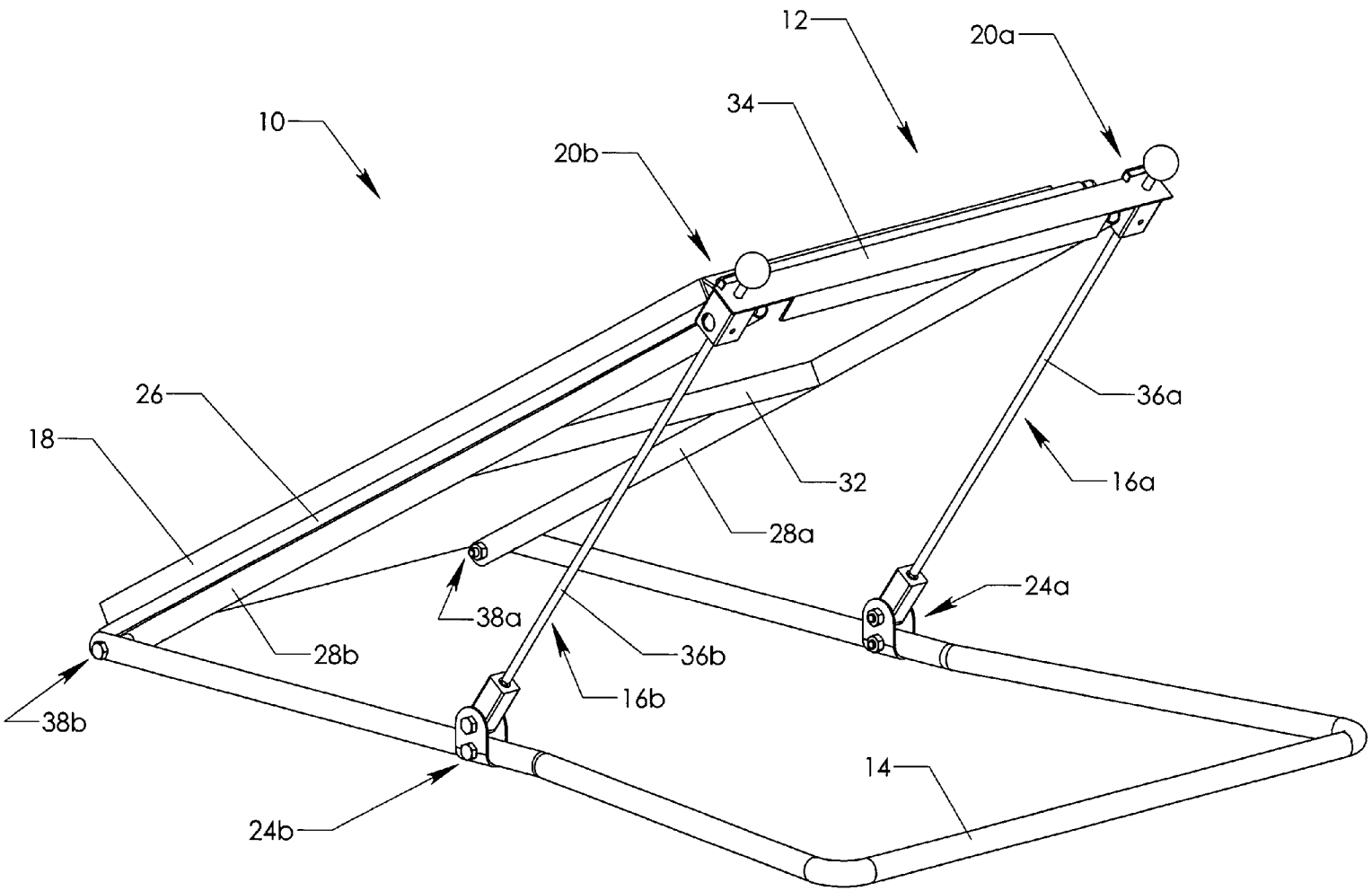
FIG. 2 is an isometric view from the rear of the sleeper assembly of the present invention, again shown in a fully elevated (inclined) position.

FIG. 2 is a view from the rear of sleeper assembly 10 of the present invention, again in a fully elevated or fully inclined condition. In this view, base frame 14 is shown to support left and right slide sub-assemblies 16*a* and 16*b* at left and right base pivot assemblies 24*a* and 24*b*. Platform sub-assembly 12, in this view, can be seen as including a frame of components that support backboard 26. Left and right backboard side braces 28*a* and 28*b* are disclosed with backboard cross-brace 32 connecting the two approximately midway along the length of backboard 26. Left and right pivoting platformlbase hinge points 38*a* and 38*b* connect base frame 14 with left and right backboard side braces 28*a* and 28*b* as shown, and preferably include TEFLON° type (polytetraflouroethelene or PTFE) plastic bushings or the like in association with bolts and lock nuts to secure the hinge in place for pivoting.

In the preferred embodiment, base frame 14 and the above described components of platform sub-assembly 12 may be constructed of thin-walled metal or plastic rigid tubing. The ends and edges of these frame components should be free from sharp corners or sharp edges. Backboard 26 may be constructed of any of a number of different rigid planar materials that may be attached to the frame components (28*a*, 28*b*, and 32) of platform sub-assembly 12. One-quarter inch fiber press board coated and/or sealed would provide a suitable material for backboard 26 to provide a platform to position sleeping surface 18.

Also shown in FIG. 2 are more details of left and right slide sub-assemblies 16*a* and 16*b*. In this view, these assemblies are seen to comprise left and right slide rods 36*a* and 36*b* that extend from left and right base pivots 24*a* and 24*b*. Sliding catch sub-assemblies 20*a* and 20*b* are operably connected by release lever 34. The detailed function and structure of left and right sliding catch sub-assemblies 20*a* and 20*b* is described further below.

Figure 3:
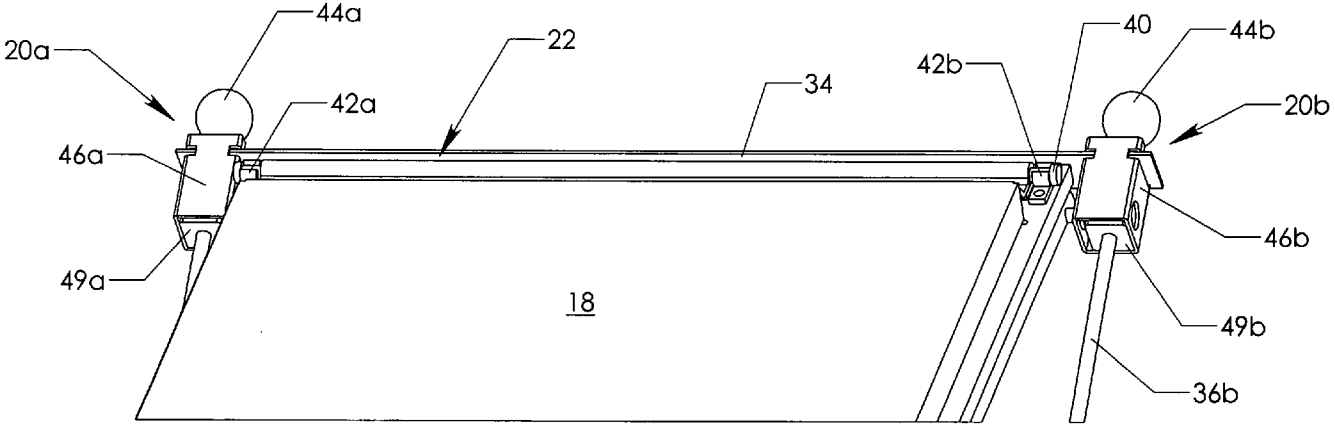
FIG. 3 is a detailed isometric view of the top edge of the sleeper assembly disclosing the mechanism for elevating and lowering the inclined surface.

FIG. 3 provides a front detailed view of the manner in which left and right sliding catch sub-assemblies 20*a* and 20*b* are operable. In addition, this view shows the manner in which sleep surface 18 is retained in position on backboard 26 along the upper edge thereof. Sleep surface retention sub-assembly 22 includes retention bar 40, which in the preferred embodiment is a cylindrical rod that extends through a tubular construction made from, for example, an extension of the fabric cover associated with sleep surface 18. The ends of retention bar 40 are exposed as shown and are placed into and retained by left and right retention clips 42*a* and 42*b*. This arrangement allows sleep surface 18 to be removed from the sleeper assembly 10 for the purpose of either exchanging the sleep surface or washing the surface or the surface fabric material.

Figure 4:
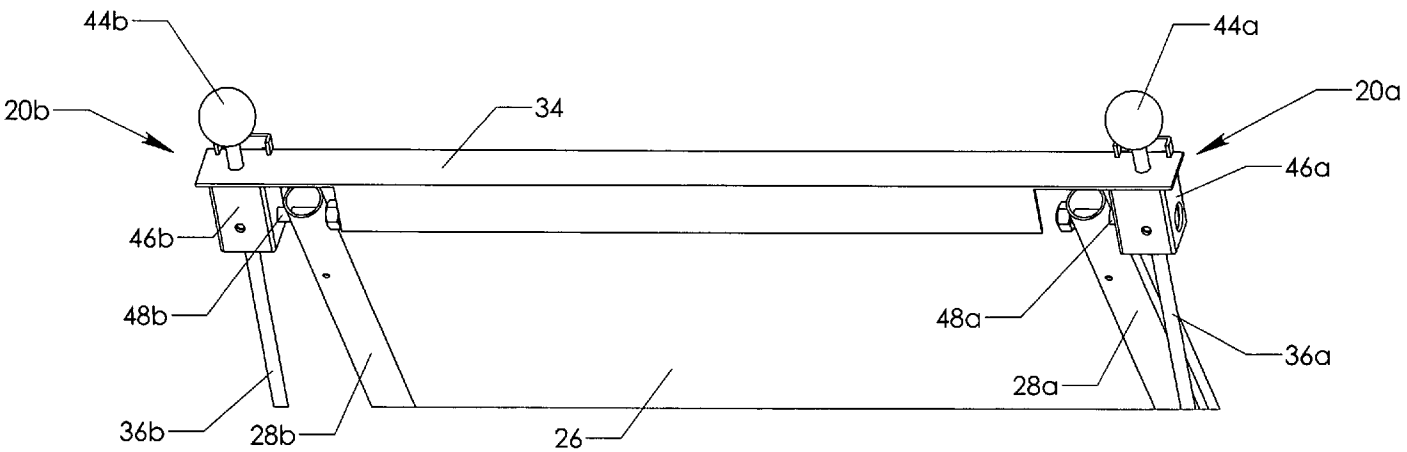
FIG. 4 is an isometric view from the rear of the components shown in FIG. 3.

Left and right slide rods 36*a* and 36*b* as shown in FIGS. 3 and 4 each extend through left and right sliding catch sub-assemblies 20*a* and 20*b* respectively, and by way of the mechanisms contained in sliding catch sub-assemblies 20*a* and 20*b* and release lever 34, are held tightly within the assemblies, or are released (in the manner described above) such that the inclination of the sleeping surface may be altered. Left and right sliding catch sub-assemblies 20*a* and 20*b* are generally constructed from left and right slide sleeves 46*a* and 46*b* as well as left and right slide inserts 49*a* and 49*b*. Slide rods 36*a* and 36*b* each are terminated by left and right slide stops 44*a* and 44*b* respectively. These slide stops 44*a* and 44*b* not only cap the end of slide rods 36*a* and 36*b*, but also provide an appropriate stop mechanism to terminate the range of motion for the inclined surface.

The view in FIG. 4 discloses many of the same components as disclosed and described above with respect to FIG. 3. In this view, backboard 26, frame components 28*a* and 28*b*, and the manner in which they connect to sliding catch sub-assemblies 20*a* and 20*b* are disclosed in more detail. Left and right slide pivot shafts 48*a* and 48*b* are shown to provide the pivoting connection between left and right sliding catch sub-assemblies 20*a* and 20*b* and left and right backboard side braces 28*a* and 28*b*. Release lever 34 is once again shown to extend between left and right sliding catch sub-assemblies 20*a* and 20*b* in a manner that allows the user to simultaneously release both sliding catch sub-assemblies by rotating release lever 34.

Figure 5:
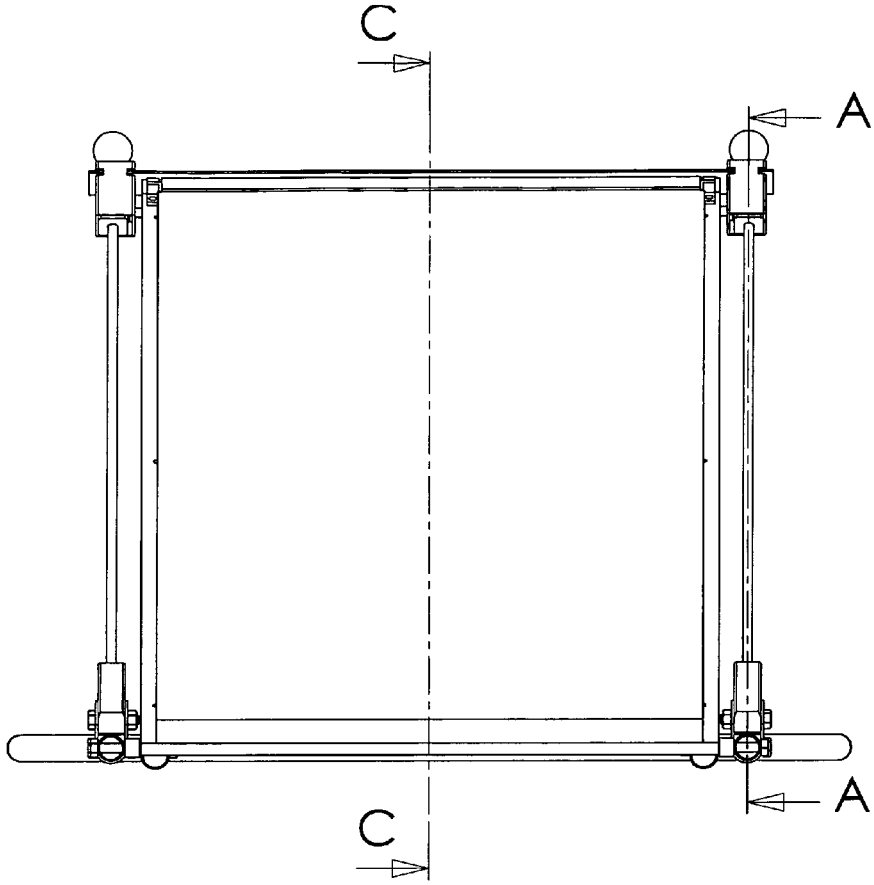
FIG. 5 is a front plane view of the sleeper assembly of the present invention, again in a fully elevated (inclined) position.
Figure 6:
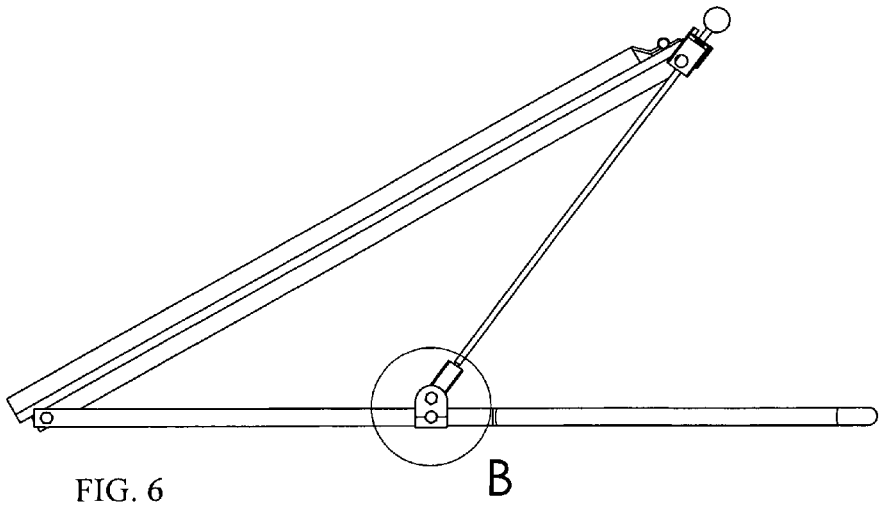
FIG. 6 is a side plan view of the sleeper assembly of the present invention, again in a fully elevated (inclined) position.
Figure 7:
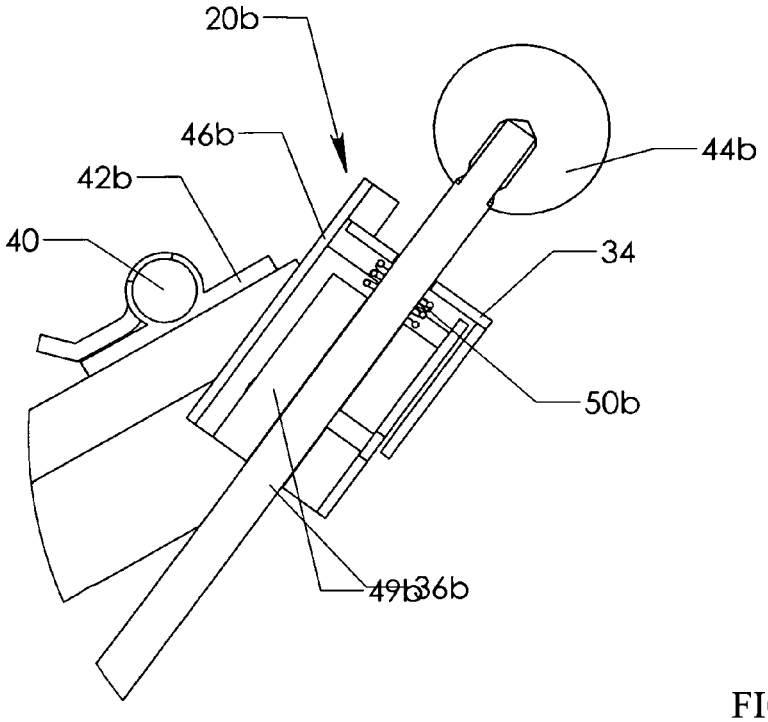
FIG. 7 is a detailed cross-sectional view taken along section line A-A in FIG. 5 of the sliding catch sub-assembly of the present invention.
Figure 8:
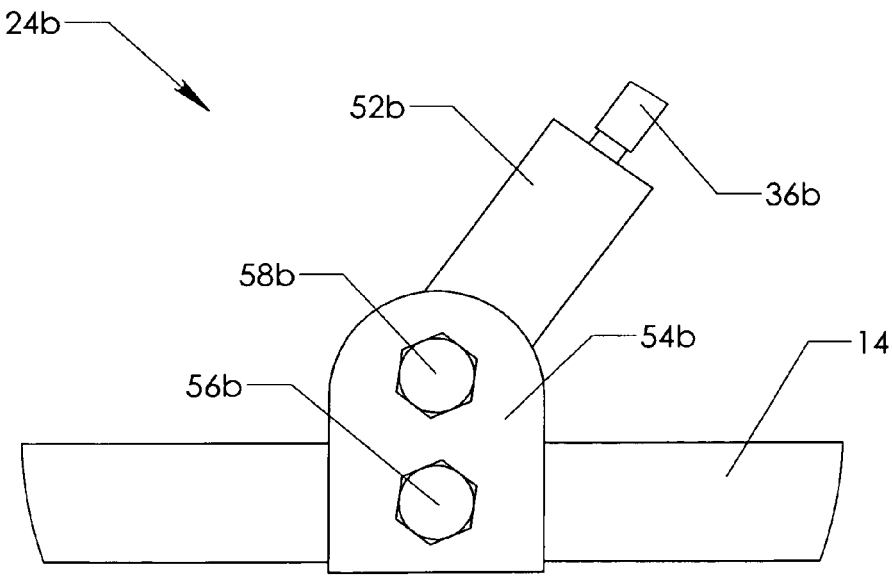
FIG. 8 is a detailed side plan view (detail B shown in FIG. 6) of the base pivot assembly of the present invention.
Figure 9:
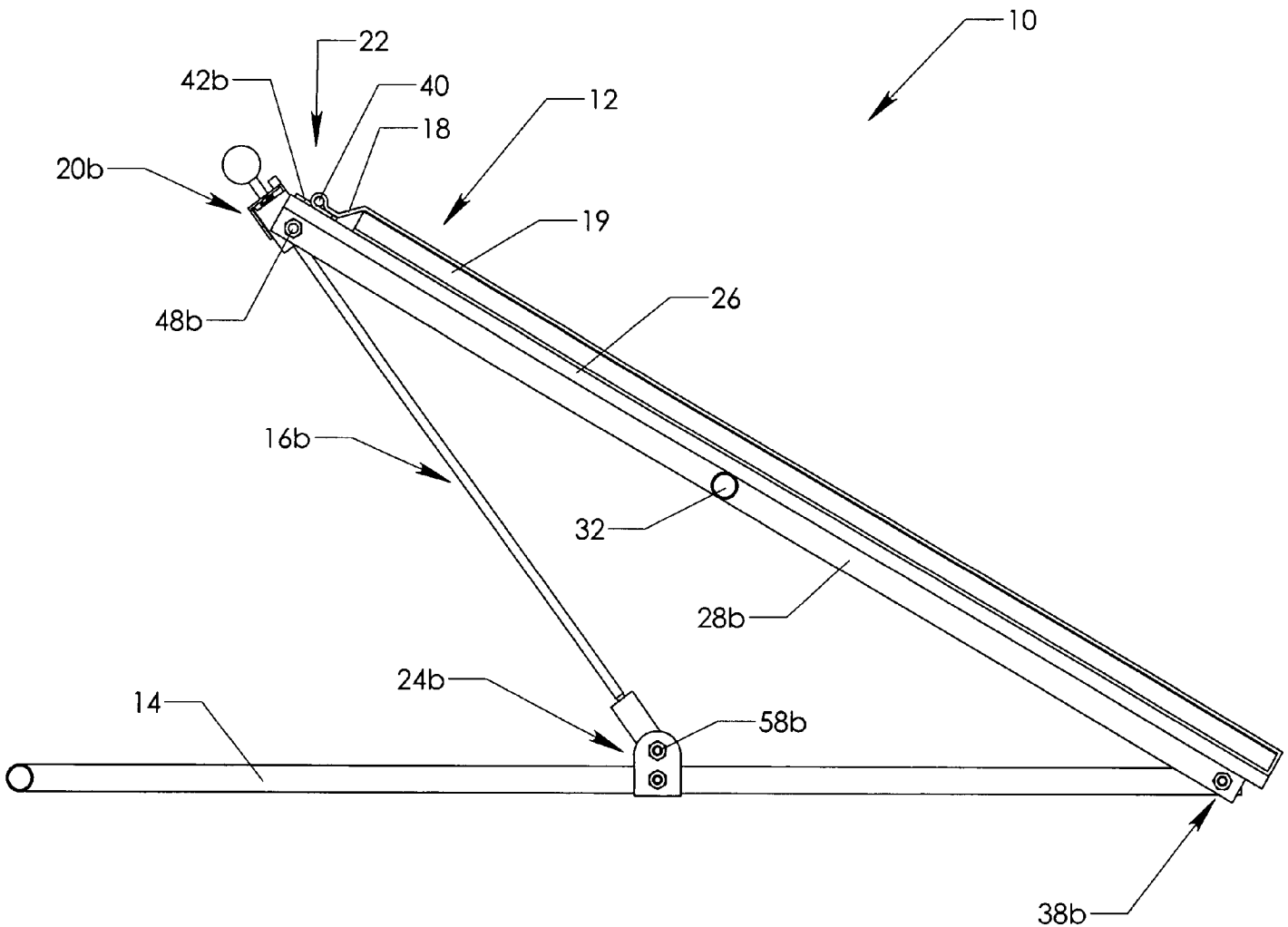
FIG. 9 is a cross-sectional view taken along section line C-C in FIG. 5 of the sleeper assembly of the present invention in a fully elevated (inclined) position.

Reference is made briefly to FIGS. 5 and 6 as reference figures for the detailed views shown in FIGS. 7, 8, and 9. The detailed cross-sectional view of left sliding catch sub-assembly 20*b* (for example) is taken along cross-section line A-A shown in FIG. 5. A detailed side view of left base pivot assembly 24*b* (for example) is taken from detailed location B shown in FIG. 6. Finally, the cross-sectional view shown in FIG. 9, which details not only the general structure of the sleeper assembly 10, but also the cross-sectional structure of the platform sub-assembly 12, is taken along section line C-C in FIG. 5.

As mentioned above, FIG. 7 shows, in cross-sectional detail, the internal structure of left sliding catch sub-assembly 20*b*. It is understood that the internal structure of sliding catch sub-assembly 20*a* is a mirror image of the assembly shown and discussed herein with respect to FIG. 7. Slide rod 36*b* extends up through sliding catch sub-assembly 20*b* and is terminated by slide stop 44*b*. In the preferred embodiment, slide stop 44*b* may simply be a rigid sphere (such as hard plastic or wood) with an aperture suitable for receiving and retaining the upper end of slide rod 36*b*. Sliding catch sub-assembly 20*b* is generally constructed from slide sleeve 46*b* and slide insert 49*b*. Slide sleeve 46*b* is structured with a lip so as to retain one edge of release lever 34, and thereby provide a pivot point for the rotational movement of release lever 34 under the influence of catch spring 50*b*. Catch spring 50*b* is positioned between slide insert 49*b* and release lever 34. In this manner, release lever 34 is preferenced upward, away from slide insert 49*b* in a manner that rotates the aperture opening through which slide rod 36*b* extends at an increased angle. The aperture in release lever 34, through which slide rod 36*b* extends, is sized to just accommodate slide rod 36*b* when the top plane of release lever 34 is positioned orthogonal to the axis of slide rod 36*b*. When release lever 34 is rotated at an angle, the effective diameter of the aperture is reduced, thereby gripping opposing side surfaces of slide rod 36*b*, and retaining it in a fixed position with respect to release lever 34. As weight on the sleeping surface increases, the engagement force between release lever 34 and slide rod 36*b* also increases. Subsequent rotation of release lever 34, as by pressure against catch spring 50*b*, serves to release sliding catch sub-assembly 20*b* from its frictional engagement with slide rod 36*b*.

Reference is now made to FIG. 8 for a detailed description of base pivot 24*b* of the present invention. It is understood that base pivot 24*a* is a mirror image of the components and structures shown in FIG. 8. Base frame 14 is fitted with a base pivot clip 54*b* as shown. Fixed stay point 56*b* positions and retains base pivot clip 54*b* stationary on base frame 14. Pivoting stay point 58*b* extends through base pivot clip 54*b* and further through slide base connector 52*b*. Slide base connector 52*b* is free to pivot with respect to pivoting stay point 58*b*. Slide rod 36*b* is centrally attached to slide base connector 52*b* in a manner that allows the two components to pivot together. Left and right base pivot assemblies 24*a* and 24*b* may be structured over a range of positions on base frame 14 (as shown in FIGS. 1 and 2) in a manner that might advantageously alter the geometry of the overall sleeper assembly 10 without departing from the spirit and function of the design.

Reference is finally made to FIG. 9 for a description of the structural details of backboard 26 as part of platform sub-assembly 12, as well as the details of sleep surface 18 and its attachment to backboard 26. In this view, right platform/base hinge point 38*b* is clearly seen as the connection between backboard side brace 28*b* and base frame 14. Slide pivot shaft 48*b* is seen as the pivoting connection between backboard side brace 28*b* and sliding catch sub-assembly 20*b*. In this manner, sliding catch sub-assembly 20*b* may slide along slide sub-assembly 16*b* from its fully elevated or inclined position to a fully lowered or horizontal position. Backboard side brace 28*b* is connected to the opposing side brace 28*a* (not shown) by way of backboard cross brace 32. It is understood that slide sub-assembly 16*a*, sliding catch sub-assembly 20*a*, base pivot assembly 24*a*, backboard side brace 28*a*, platform/base hinge point 38*a*, slide pivot shaft 48*a*, and pivoting stay point 58*a*, are all mirror images of the corresponding components and structures shown in FIG. 9.

Sleep surface retention sub-assembly 22 is seen in cross-section at the top edge of backboard 26. As it is described above, backboard 26 is positioned and permanently retained on the framework comprising backboard side brace 28*b* and backboard cross brace 32. Removably attached to backboard 26 is sleep surface 18 by way of sleep surface retention sub-assembly 22 as described above. Seen in this view, as also seen in FIG. 7, is the manner of retaining retention bar 40 in the appropriately configured retention clips 42*b* on sleeper assembly 10. Also as indicated above, a fabric cylinder may be sewn to receive this rod and allow for the complete removal of sleep surface 18 from the sleeper assembly 10 as necessary.

Sleep surface 18 is constructed around sleeping pad insert 19, which may be a thin, open cell foam insert to provide some cushioning to the sleep surface. The fabric surrounding this sleeping pad insert 19 may be any of a number of different slip resistant materials, as discussed above. These materials may be sewn to form an envelope or pocket into which sleeping pad insert 19 may be inserted or removed for the purpose of cleaning, both the fabric and the insert, as needed.

It will be understood by those skilled in the art that the structures described herein and the drawing figures relating to these descriptions are intended primarily to clarify the functional aspects of each of the components of the present invention rather than to limit their structures. The configurations and structures associated with the actual product constructed according to the present invention will likely have more ergonomic shapes and surfaces to accommodate the infant nursing purposes of the invention. As an example, although the preferred embodiment of the present invention has been disclosed as being configured in a generally rectangular form, it is anticipated that rounded corners will likely provide a more suitable environment for placement of the nursing infant. Likewise, the various bolts, nuts and other attachment devices described in conjunction with the preferred embodiment of the present invention will be covered, protected, or otherwise prevented from exposing sharp edges or breakable components. In a similar manner, variations on the method for attaching sleep surface 18 to backboard 26 are anticipated and include the integration of a second pocket (where, for example, sleep surface 18 is constructed of fabric material) along an upper edge thereof that would fit over the top edge of backboard 26 and backboard side braces 28*a* and 28*b*.

Alternative embodiments of the present invention focus on modifications to the manner in which the infant is retained upon the inclined surface through its full range of variable inclinations. As stated above, one primary object of the present invention is to eliminate the need for any type of harness or other specialized clothing that the infant must wear in order to utilize the sleeper assembly. Alternative embodiments of the present invention, however, may include matching the surface of sleep surface 18 with the fabric of clothing worn by the infant utilizing the sleeper assembly. Certain fabric materials which may easily accommodate the construction of infant sleepwear could be preferable when used in conjunction with certain cover fabric material utilized with the sleep surface. Other fabric materials for enclosing the sleep surface of the present invention may be utilized which have been shown to grip or otherwise resist slipping against any of the most commonly used fabrics in the construction of infant clothing, especially sleepwear. As indicated above, certain types of material such as the synthetic material used to prevent the slippage of rugs on hard floors and the like, may be constructed into the pocket mentioned above for insertion of the sleeping pad cushion and thereby provide the necessary slip resistant surface for most all types of infant clothing.

There are specific methods of using the assembly of the present invention that are to be anticipated given the functional descriptions of the assembly components. One such method has been described wherein the mother nursing the infant might position the infant on a horizontally positioned (no inclination) sleeper assembly and then position the assembly with the infant thereon next to her on the surface of a bed. It may be desirable and appropriate to loosely position blankets and/or pillows adjacent to the sleeper assembly to allow the mother to lie comfortably next to the infant while the infant is positioned on the assembly. As soon as the infant has been nursed and has fallen asleep, the padding materials may be gently removed to allow the sleeper assembly to be inclined to an inclination more appropriate for promoting the retention of milk by the infant.

Alternatively, the infant may be placed on an already inclined sleeper assembly if the mother herself is propped up and positioned appropriately on pillows, blankets, or other objects. In such circumstances, the slip resistant surface material associated with the present invention becomes the important factor in allowing the infant to be retained on the inclined surface while not being disturbed if the infant falls asleep during nursing. In any event, it is the combination of the slip resistant support surface provided by the present invention, with the adjustable inclination features of the invention that provides a versatile inclined infant sleeper system that addresses many of the problems associated with infants subject to gastric reflux conditions and the associated respiratory conditions that complicate sinus/phlegm drainage.

As indicated above, a further alternative embodiment of the present invention eliminates the mechanism for varying the inclination and relies instead upon other objects, such as pillows, blankets, towels, etc. placed under the support structure to achieve the desired inclination. In this alternative embodiment, the inclined sleeper would simply be comprised of the primary components of platform sub-assembly 12 as shown in FIG. 1, namely; sleep surface 18 (with sleeping pad insert 19 as shown in FIG. 9); sleep surface retention sub-assembly 22 (comprising retention bar 40 and left and right retention clips 42*a* and 42*b* as shown in FIG. 3); and backboard 26. Variations on the material associated with the sleep surface in this alternative embodiment would be the same as those associated with the first preferred embodiment described above.

Although the present invention has been described in terms of the foregoing preferred embodiments, this description has been provided by way of explanation only, and is not intended to be construed as a limitation of the invention. Those skilled in the art will recognize modifications of the present invention that might accommodate infants of specific age and/or size (weight), or which might accommodate variations in sleeping environments. Such modifications as to structure, orientation geometry, and even materials, do not necessarily depart from the spirit and scope of the invention.

I claim:

1. A sleeping surface assembly for an infant, the assembly capable of being adjusted through a range of inclination angles, the sleeping surface assembly comprising:

(a) a base frame, the base frame being generally planar in configuration and serving as a support for the balance of the sleeping surface assembly;

(b) a backboard platform, the backboard platform comprising a rigid material suitable for supporting the weight of an infant, the backboard platform hingedly connected to the base frame and capable of pivoting from a position generally parallel to the plane of the base frame to a position at an inclined angle to the plane of the base frame;

(c) a retention surface, the retention surface positioned on the backboard platform and retained thereto; and (d) a sliding clamp assembly connecting the backboard platform with the base frame and thereby supporting the backboard platform, the sliding clamp assembly having two slide members, two releasable clamps, each positioned to alternately grip or release one of the two slide members, and a single common release lever to direct the release of the clamps from gripping the slide members, the single common release lever comprising an angled plate defining two apertures, each of the two slide members passing through one of the apertures in the angled plate, whereby in a first angled orientation, first and second edges of each of the apertures frictionally engage opposing surfaces of the two slide members, and in a second angled orientation, the first and second edges of each of the apertures are freed from frictional contact with the opposing surfaces of the slide members, the releasable clamps sliding on the slide members and thereby varying an angle of inclination between the backboard platform and the base frame.

2. The sleeping surface assembly of claim 1 wherein the two slide members of the sliding clamp assembly each comprise a rod hingedly connected at a first end thereof to the base frame and each slidingly held within one of the releasable clamps along a section of the rod apart from the first end thereof.

3. The sleeping surface assembly of claim 1 wherein the two slide members of the sliding clamp assembly each further comprise an end stop that limits the upper range of the sliding movement of the releasable clamp on the slide member rod.

4. The sleeping surface assembly of claim 1 wherein the sliding clamp assembly further comprises at least one preferencing spring, the spring preferencing the angled plate in a manner to orient the angled apertures into the first angled orientation.

5. The sleeping surface of claim 1 wherein the backboard platform has a lower edge and an upper edge, the lower edge hingedly connected to the base frame and the upper edge hingedly connected to the sliding clamp assembly.

6. The sleeping surface assembly of claim 1 wherein the retention surface comprises a slip resistant material on at least a side thereof facing the infant, the slip resistant material serving to reduce the slippage of the infant across the backboard platform.

7. The sleeping surface assembly of claim 1 wherein the retention surface comprises a cushion and a cover, the cover extending over the cushion on at least a side thereof facing the infant.

8. The sleeping surface assembly of claim 7 wherein the cover comprises a slip resistant material on at least a side thereof facing the infant, the slip resistant material serving to reduce the slippage of the infant across the backboard platform.

9. The sleeping surface assembly of claim 7 wherein the cover comprises a fabric material configured as a pocket and the cushion is removably insertable into the fabric pocket formed by the cover.

10. The sleeping surface assembly of claim 9 wherein the fabric material comprises a washable material.

11. The sleeping surface assembly of claim 1 wherein the retention surface is retained on the backboard platform along an upper edge thereof.

12. The sleeping surface assembly of claim 11 wherein the retention surface is removably retained on the backboard platform by a clip assembly, the clip assembly comprising a rod extending along and attached to an upper edge of the retention surface and at least one clip fixed on the upper edge of the backboard platform, the at least one clip capable of receiving and removably retaining the rod.

13. The sleeping surface assembly of claim 1 wherein the backboard platform comprises a platform frame and a backboard attached to the platform frame, the platform frame hingedly connected to the base frame at a lower end of the platform frame and hingedly connected to the sliding clamp assembly at an upper end of the platform frame.

14. The sleeping surface assembly of claim 1 wherein the inclined angle between the backboard platform and the base frame is in the range from 0° through 45° inclusive.

15. The sleeping surface assembly of claim 1 further comprising clothing on the infant of a first material and wherein the retention surface comprises a surface of a second material, the first material resistant to slippage against the second material.

* * * * *